US005706790A

United States Patent [19]

Kemmler et al.

[11] Patent Number: 5,706,790

[45] Date of Patent: Jan. 13, 1998

[54] ARRANGEMENT FOR CONTROLLING THE INTAKE AIR FLOW OF A SUPERCHARGED INTERNAL COMBUSTION ENGINE

[75] Inventors: Roland Kemmler, Stuttgart; Wolfgang Widmann, Erdmannshausen, both of Germany

[73] Assignee: Mercedes - Benz AG, Stuttgart, Germany

[21] Appl. No.: 559,137

[22] Filed: Nov. 17, 1995

[30] Foreign Application Priority Data

Nov. 18, 1994 [DE] Germany ..... 44 41 164.2

[51] Int. Cl.[6] ..... F02D 23/02

[52] U.S. Cl. ..... 123/564; 60/307

[58] Field of Search ..... 60/307; 123/564

[56] References Cited

U.S. PATENT DOCUMENTS 4,873,961 10/1989 Tanaka ..... 123/564
5,458,855 10/1995 Gillbrand ..... 60/307

FOREIGN PATENT DOCUMENTS 2 027 883 12/1971 Germany .
34 11 496 4/1985 Germany .
35 06 235 9/1985 Germany .
37 20 942 1/1988 Germany .
5-312048 11/1993 Japan ..... 123/564

*Primary Examiner*—Michael Koczo
*Attorney, Agent, or Firm*—Klaus J. Bach

[57] ABSTRACT

In an arrangement for controlling the charging air flow of a supercharged internal combustion engine which has an intake air pipe with a throttle valve connected to the discharge side of a supercharger and a communication pipe extending from the intake air pipe to the engine exhaust manifold for supplying air to the engine exhaust gas, an air supply pipe extends from an air filter housing to the supercharger suction side and a return air duct including a flow control valve extends from the intake air pipe to the air filter housing for recirculating air to the supercharger suction side through the air filter housing under the control of the flow control valve for controlling the air pressure in the engine intake air pipe.

10 Claims, 2 Drawing Sheets

ARRANGEMENT FOR CONTROLLING THE INTAKE AIR FLOW OF A SUPERCHARGED INTERNAL COMBUSTION ENGINE

BACKGROUND OF THE INVENTION

The invention resides in an arrangement for controlling the charging air flow of a supercharged internal combustion engine from a supercharger to the engine by way of an intake air conduit which includes a throttle valve and upstream of the throttle valve a return air duct returning compressed air back to the suction side of the supercharger. The return air duct includes a return air flow controller and a connecting line providing for communication with the engine exhaust pipe.

DE 35 06 235 A1 discloses an arrangement for controlling the supercharger air flow for a supercharged internal combustion engine of the type with which the present invention is concerned. The arrangement comprises a charger for supplying compressed air to the internal combustion engine by way of a charging air conduit which includes a throttle valve and to which, upstream of the throttle valve and downstream of the charger, an air return conduit is connected which leads to the suction side of the charger and which includes a flow control device. The arrangement also includes a connecting line extending between the discharge side of the charger and an engine exhaust pipe which includes a control valve by which secondary air flow from the charger discharge side to the engine exhaust pipe can be controlled.

For further background information, reference is made to DE-OS 20 27 883, DE OS 34 11 496 A1, and DE OS 37 20 942 A1.

The prior art arrangements for controlling the charging air flow have a disadvantage in that, over a wide operating range of the internal combustion engine, the secondary air flow to the engine exhaust pipe can only be provided if the secondary air flow control valve is arranged at the point of jointure of the connecting line with the charger discharge pipe and is furthermore capable of acting as a charger ram valve since the secondary airflow pressure needs to be higher than the exhaust gas back pressure which is above the ambient air pressure.

It is the object of the present invention to provide an arrangement for controlling the charging air flow of a supercharged internal combustion engine in a constructively simple and inexpensive manner in such a way that optimal amounts of secondary air can be supplied to the exhaust gas of an internal combustion engine over a wide operating range so as to achieve the best possible exhaust gas composition values.

SUMMARY OF THE INVENTION

In an arrangement for controlling the charging air flow for a supercharged internal combustion engine which has an intake air pipe with a throttle valve connected to the discharge side of a supercharger and a communication pipe extending from the engine intake air pipe to the engine exhaust manifold for supplying air to the engine exhaust gas, an air supply pipe extends from an air filter housing to the supercharger suction side and a return air duct including a flow control valve extends from the intake air pipe to the air filter housing for recirculating air to the supercharger suction side through the air filter housing under the control of the flow control valve for controlling the air pressure in the engine intake pipe.

With the arrangement according to the invention, the amount of secondary air supplied to the exhaust has can be controlled optimally for any operating point of the internal combustion engine so that excellent engine emission values can be achieved.

Furthermore, this can be achieved without the need for additional equipment for the injection of secondary air since the engine air supercharger can be utilized for that purpose. In addition, for the control of the secondary air flow and the release of the excess air, only an air flow control device is required.

If the engine exhaust system includes a catalytic converter, it is advantageous that, with the additional oxidation provided for by the secondary air flow, the exhaust gas is heated and the catalytic converter becomes rapidly operative whereby the HC emission of the engine during warm up is substantially reduced.

If the air flow control valve can be operated very rapidly, it is possible to prevent the occurrence of pressure peaks in the intake air pipe which appear immediately after the engine throttle valve is closed since then the supercharger operates against the closed throttle valve. With the airflow control valve open, the pressurized air can be discharged through the return duct to the air filter housing and returned to the suction side of the supercharger. If the engine air intake pipe includes an air mass flow sensor preferably arranged downstream of an intercooler and upstream of the throttle valve, highly accurate measuring results can be obtained for the air mass flowing through the air intake pipe and rapid determination of engine load is possible.

If the length of the return air duct between the air flow controller and its jointure with the intake air pipe is tuned to the pulse frequency of the supercharger, a parallel resonator can be formed in an advantageous manner in such a way that the occurrence of unwanted frequencies is suppressed when the air flow controller is closed.

If a perforated plate with a given aperture cross-section is arranged at the discharge side of the supercharger, the pulses effective at the discharge side of the supercharger are attenuated and the noise generated by the supercharger is substantially reduced.

The invention and further embodiments thereof will become more readily apparent from the following description of the invention on the basis of the accompanying drawings.

DESCRIPTION OF THE PREFERRED EMBODIMENTS

Figure 1:
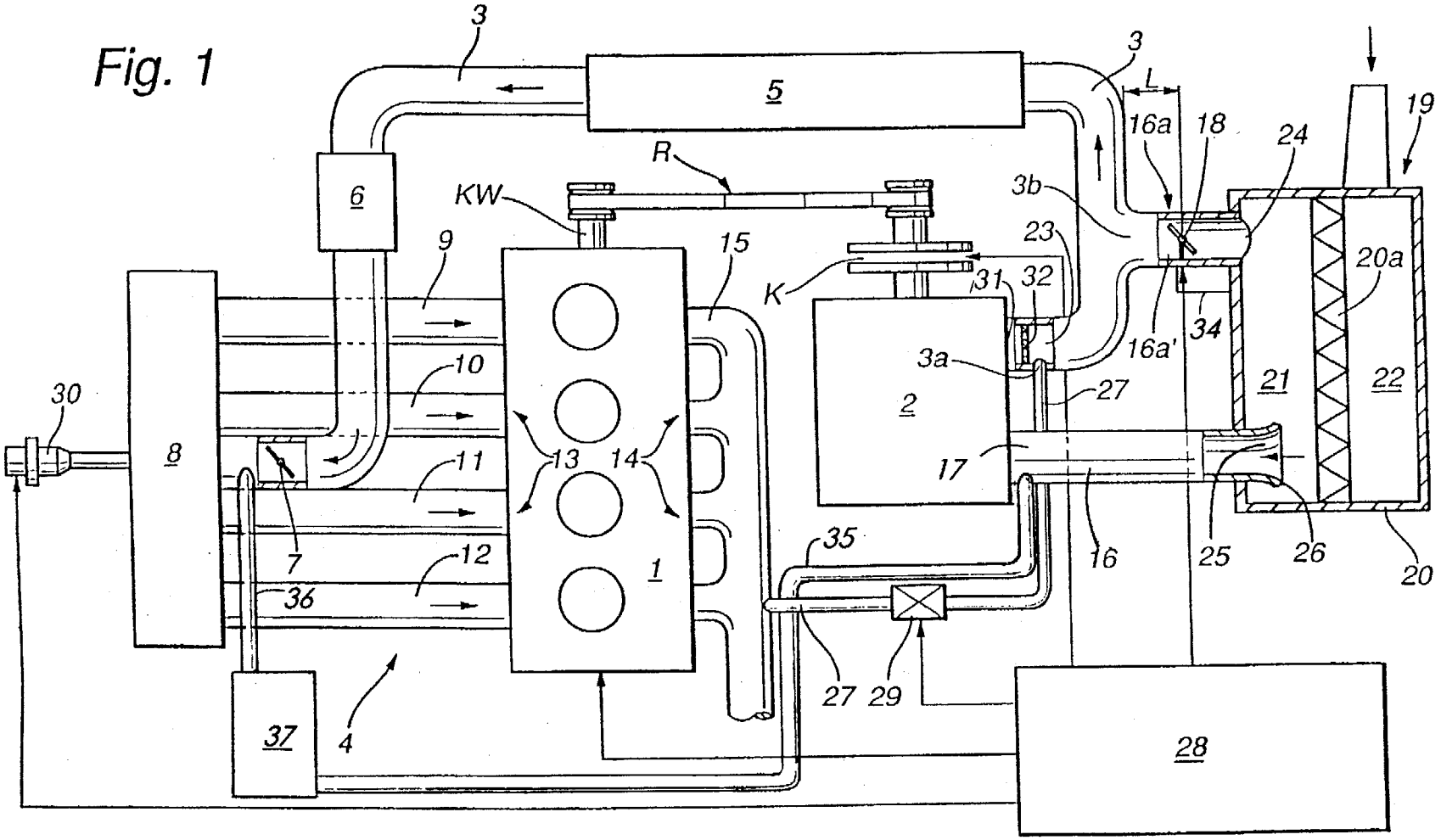
FIG. 1 is a schematic representation of the invention showing an arrangement for controlling the intake air flow of a supercharged internal combustion engine which includes a supercharger, an intake air pipe with an air intercooler and a throttle valve and an air supply pipe with air filter housing and further a communication line extending from the pressure side of the charger to the engine exhaust pipe.

FIG. 1 shows an embodiment of the invention in principle in a schematic representation. It shows an arrangement for controlling the intake air flow of a supercharged internal combustion engine 1 with a supercharger 2 for supplying intake air via an intake air pipe 3 to an intake manifold structure 4 of the internal combustion engine 1. The supercharger 2 is driven by the crankshaft KW of the internal combustion engine 1 by way of a V-belt drive R and a mechanical clutch K.

Downstream of the supercharger 2, the intake air pipe 3 includes an intercooler 5, an air mass flow sensor 6 (for example, a hot filament anemometer) and a throttle valve 7. The intake air pipe 3 leads to a distribution chamber 8 of the manifold structure 4 from which single suction pipes 9, 10, 11, and 12 extend to the intake side 13 of the internal combustion engine 1. The air mass flow sensor 6 is arranged in the intake pipe 3 downstream of the intercooler 5 and upstream of the throttle valve 7.

At the engine exhaust side 14, the internal combustion engine 1 is provided with an exhaust manifold 15 which leads to an engine exhaust system which is not shown in the figure.

At the suction side 17, the supercharger 2 is provided with an air supply pipe 16 through which air is supplied to the charger 2 from an air filter 19. The air filter 19 comprises a filter housing 20 in which an air filter element 20*a* is disposed which divides the air filter housing 20 into a clean air side 21 and an ambient air side 22.

A return air duct 16*a* extends between the air filter housing 20 and the supercharger discharge end 23 of the intake air pipe 3 so that pressurized air can be returned from the supercharger to air filter housing 20, from where it is returned to the supercharger 2 through the air supply pipe 16.

The return air duct 16*a* includes an air flow control valve 18 which can be rapidly operated so as to be able to maintain within the intake air pipe 3 a certain air pressure dependent on the engine operating conditions. The valve 18 is controlled by an engine controller 28. The openings 26 and 24 of the air supply pipe 16 and the return air duct 16*a* are arranged at the clean air side 21 of the air filter housing 20 so that the ambient air passes through the filter and only filtered air is supplied to the engine through the supercharger 2. Within the air filter housing 20, the air supply pipe 16 has a flared end 26 which provides for advantageous air flow conditions for the air entering the supercharger through the air supply pipe 16.

At the supercharger discharge side 23, a communication line 27 is connected to the intake air pipe 3 at 3*a* which leads to the exhaust manifold 15 of the internal combustion engine 1 and which includes a control valve 29 operated by the engine controller 28. The connecting point 3*a* for the communication line 27 is arranged upstream of the jointure 3*b* of the air return duct 16*a* with the intake air pipe 3.

The engine controller 28 is not only in communication with the control valve 29 and with the air flow control valve 18, but also with the internal combustion engine 1 and with a pressure sensor 30 which is arranged so as to sense the air pressure in the air distribution chamber 8 of the manifold structure 4.

The fast switching air flow control valve 18 is capable of switching from an open to a closed position and vice versa in about 50 to 100 milliseconds. As shown in FIG. 1, the air flow control valve 18 is arranged adjacent the air filter housing 20. It is accurately controllable and may be a butterfly valve, a flat slide valve or a rotary slide valve. The air flow control valve 18 includes an electric servomotor 34 which may be mounted on the air filter housing and which is capable of rapidly operating the valve. It is actuated by the controller 28 so as to achieve the very fast control motions of the valve. (The electronics of an integrated position control circuit are arranged directly at the air flow control valve 18.)

The distance of the air flow control valve 18 from the intake air pipe connection 3*b*, that is, the length L of the duct section 16*a* as shown in FIG. 1 is tuned to the pulsation frequency of the supercharger 2.

At the discharge end 31 of the supercharger 2, there is provided a perforated plate structure 32 adapted to silence the compressed air leaving the supercharger 2.

The arrangement may include a regeneration conduit comprising two conduit sections 35, 36 connected to an activated carbon filter 37 for the adsorption and desorption of fuel vapors wherein the conduit section 35 is in communication with the suction side 17 of the supercharger 2 and the other conduit section 36 is connected to the intake air pipe 3 immediately adjacent the throttle valve 7.

The air flow control valve 18 is further provided with means for the long term adaptation which includes in the controller 28 a complete performance schedule on the basis of load and engine speed for the angular position of the flow control valve 18 and which stores the stop valve location which vary over the life of the engine in an EEPROM (Electronically Erasable and Programmable Read Only Memory).

Figure 2:
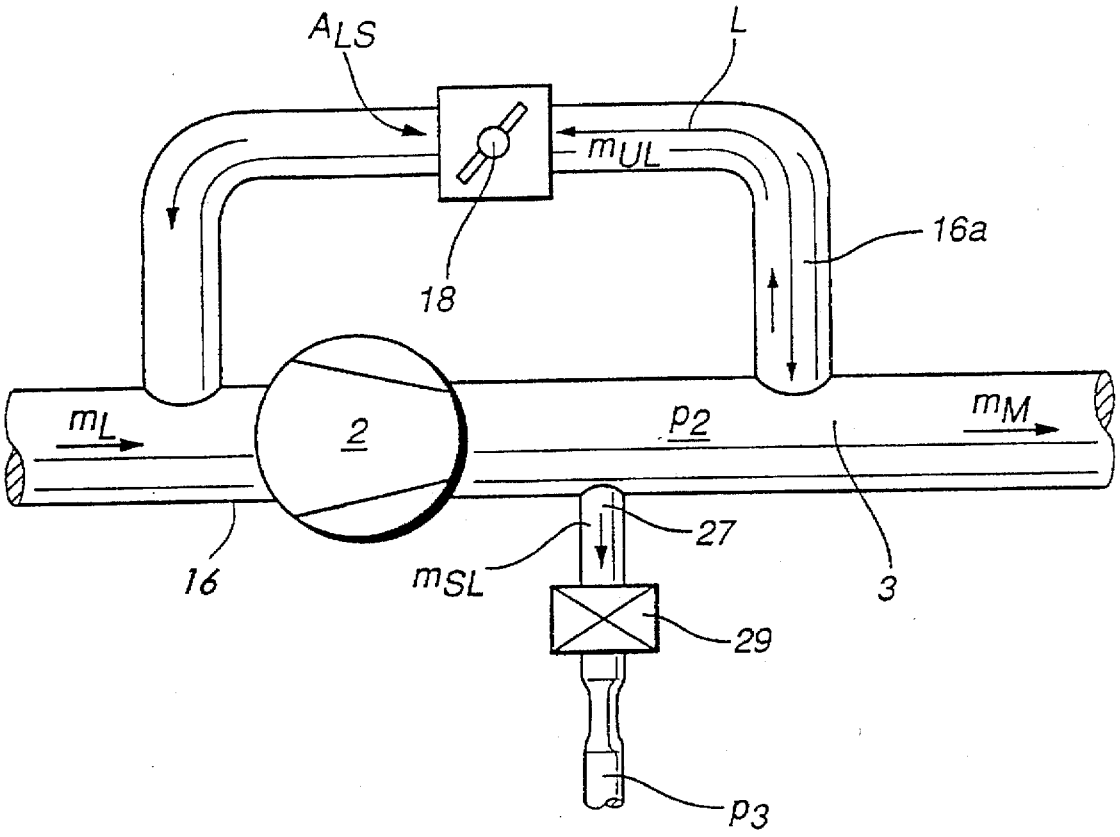
FIG. 2 shows the arrangement partially, with a charger and a return line, but no air filter housing to facilitate explanation of the pressure and flow conditions.

FIG. 2 shows an embodiment of the invention wherein the supercharger 2 and the supercharger return air duct 16*a* including the air flow control valve 18 are arranged in principle, like in the arrangement of FIG. 1, but without the air filter housing to indicate the flow and pressure conditions which are established in the intake air pipe to supply the appropriate amount of secondary air to the engine exhaust gas through the communication line 27. The same reference numerals are used for functionally identical components.

Below, the operation of the arrangement according to the invention will be described in greater detail. Control of the secondary air mass flow $m_{SL}$ in the communication line 27 is achieved by accurately adjusting the control valve 18. The air mass flow $m_L$ through the supercharger 2 comprises the air mass flow $m_M$ through the internal combustion engine 1, the return air mass flow $m_{UL}$ through the return air duct 16*a* and the secondary air mass flow $m_{SL}$ through the communication line 27 ($m_L=m_M+m_{UL}+m_{SL}$). A precondition for the secondary air supply to the exhaust manifold 15 is that the charging air pressure $P_2$ at the discharge side of the charger 2 is higher than the exhaust gas pressure $P_3$ in the exhaust manifold 15.

The charging air pressure $P_2$ however depends on the position of the air flow control valve 18 that is on the flow cross-section $A_{LS}$ provided by the flow control valve 18 in the return air duct 16*a*.

For each particular operating point of the internal combustion engine 1 ($m_L$ and $m_M$ are constant), the secondary air mass flow $m_{SL}$ can be optimized by adjustment of the air flow through the air return duct 16*a* that is by controlling the flow cross-section $A_{LS}$ of the flow control valve 18 to provide a particular pressure $P_2$ at the discharge side 23 of the charger 2. The engine controller 28 can be provided with a complete performance schedule for the position of the air flow control valve 18 (for example, control valve position angle) in dependence on load (throttle valve position angle) engine speed and cooling water temperature. By long term adaptation within the control means for the air flow control valve 18 (learned stop positions are recorded in the EEPROM), a stable engine operation is possible over the whole engine life since, for example, dirt deposits on the control valve are recognized and compensated for by corresponding control changes.

What is claimed is:

1. An arrangement for controlling the charging air flow of an internal combustion engine having an air intake manifold with an intake air pipe and an exhaust manifold and comprising a supercharger having a suction side and a discharge side, said intake air pipe extending from the discharge side of said supercharger to said engine for supplying combustion air thereto, a throttle valve disposed in said intake air pipe for controlling the supply of combustion air to said engine, a communication line extending from said intake air pipe upstream of said throttle valve to said engine exhaust manifold for supplying air to the engine exhaust gas, an air filter housing receiving ambient air and including a filter for filtering the ambient air entering said filter housing, an air supply pipe extending from said air filter housing to the suction side of said supercharger for supplying air from said filter housing to said supercharger, a return air duct extending from said intake air pipe upstream of said throttle valve to said air filter housing to permit a return flow of air from said air intake pipe to said air filter housing and an air flow control valve arranged in said return air duct, said air flow control valve including a servomotor operated by a controller for controlling the return air flow from said intake air pipe to said filter housing, said return air duct being in communication with said air supply pipe through said filter housing.

2. An arrangement according to claim 1, wherein said air flow control valve is a fast-acting valve capable of being moved from an open to a closed position or vice versa within a time period of 50 to 100 milliseconds.

3. An arrangement according to claim 1, wherein said air filter housing has a clean air side and an ambient air side separated by said air filter, both said air supply pipe and said return air duct being in communication with said clean air side of said air filter.

4. An arrangement according to claim 1, wherein an intercooler is disposed in said intake air pipe and an air mass flow sensor is arranged in said intake air pipe downstream of said intercooler for determining the air mass flow through the internal combustion engine and accordingly the engine load.

5. An arrangement according to claim 1, wherein said airflow control valve is arranged in said return air duct at a predetermined distance from said intake air pipe which distance is tuned to the pulsation frequency of said supercharger at a certain engine speed.

6. An arrangement according to claim 1, wherein an apertured partition is arranged at the discharge side of said supercharger so as to attenuate noises generated by said supercharger.

7. An arrangement according to claim 1, wherein said air supply pipe is flared in said air filter housing so as to provide an aerodynamic entrance area for the air entering said air supply pipe.

8. An arrangement according to claim 1, wherein said air flow control valve with servomotor is mounted on said air filter housing.

9. An arrangement according to claim 1, wherein a regeneration line extends between said air supply pipe and said intake air pipe to which it is connected adjacent to said throttle valve and said regeneration line includes activated carbon filter chamber for the adsorption and desorption of fuel vapors.

10. An arrangement according to claim 1, wherein said air flow control valve is under the control of a controller which is provided with means for long term adaptation including a performance schedule based on engine load and engine speed for controlling the position of said air flow control valve and with an EEPROM in which end positions of the flow control valve, which are changing during engine life, are recorded.

* * * * *